US008505908B2

(12) United States Patent
Gendreau et al.

(10) Patent No.: US 8,505,908 B2
(45) Date of Patent: Aug. 13, 2013

(54) SHEET DECELERATION APPARATUS AND METHOD

(75) Inventors: Craig H. Gendreau, Spokane, WA (US); Curtis A. Roth, Post Falls, ID (US); Lynn E. Vershum, Coeur d'Alene, ID (US); Kevin P. Brown, Nine Mile Falls, WA (US); Michael G. Harrington, Spokane, WA (US)

(73) Assignee: J&L Group International, LLC, Keithville, LA (US)

( * ) Notice: Subject to any disclaimer, the term of this patent is extended or adjusted under 35 U.S.C. 154(b) by 0 days.

(21) Appl. No.: 13/086,162

(22) Filed: Apr. 13, 2011

(65) Prior Publication Data

US 2011/0285080 A1 Nov. 24, 2011

Related U.S. Application Data

(60) Provisional application No. 61/323,728, filed on Apr. 13, 2010.

(51) Int. Cl.
*B65H 29/68* (2006.01)

(52) U.S. Cl.
USPC ..... 271/182; 271/314

(58) Field of Classification Search
USPC ..... 271/182, 189, 314, 270, 273
See application file for complete search history.

(56) References Cited

U.S. PATENT DOCUMENTS

| | | | | |
|---|---|---|---|---|
| 1,752,648 | A | | 4/1930 | Matthews |
| 2,467,423 | A | | 4/1949 | Bruker |
| 3,507,489 | A | | 4/1970 | Wilshin et al. |
| 3,892,168 | A | | 7/1975 | Grobman |
| 4,073,223 | A | * | 2/1978 | Crawford ..... 226/88 |
| 4,189,965 | A | | 2/1980 | Kollann |
| 4,385,537 | A | | 5/1983 | Wolf |
| 4,486,012 | A | * | 12/1984 | Bock et al. ..... 271/3.15 |
| 4,966,521 | A | | 10/1990 | Frye et al. |
| 4,977,828 | A | * | 12/1990 | Douglas ..... 101/142 |
| 5,026,249 | A | | 6/1991 | Shill |
| 5,366,217 | A | * | 11/1994 | Tokuno et al. ..... 271/176 |

(Continued)

FOREIGN PATENT DOCUMENTS

| | | |
|---|---|---|
| CA | 1319161 | 6/1993 |
| DE | 21 14 865 | 10/1972 |

(Continued)

*Primary Examiner* — Jeremy R Severson
(74) *Attorney, Agent, or Firm* — Dorsey & Whitney LLP; Kenneth E. Levitt, Esq.

(57) ABSTRACT

Sheet deceleration apparatus and methods for decelerating a sheet of material for use in a sheet stacking or other application. The deceleration apparatus includes a rotatable cam nip, rotatable about a first axis and provided on one side of the travel path, such that the sheet of material can pass by the cam nip. The cam nip includes a lobe end, such that when the lobe end is away from the travel path, the sheet of material can pass substantially unimpeded past the cam nip, and when the lobe end is near the travel path, the sheet of material is nipped by the cam nip decelerating the sheet of material from the first speed to a second speed.

7 Claims, 10 Drawing Sheets

(56) References Cited

U.S. PATENT DOCUMENTS

| | | | | |
|---|---|---|---|---|
| 5,702,100 | A * | 12/1997 | Novick et al. | 271/302 |
| 5,904,465 | A | 5/1999 | Fernandez | |
| 5,938,191 | A * | 8/1999 | Morrison et al. | 271/182 |
| 5,950,510 | A | 9/1999 | Scheffer et al. | |
| 6,000,531 | A | 12/1999 | Martin | |
| 6,131,901 | A | 10/2000 | Hirohata | |
| 6,234,473 | B1 | 5/2001 | Morgan et al. | |
| 6,270,067 | B1 * | 8/2001 | Bergmann et al. | 270/13 |
| 6,427,097 | B1 | 7/2002 | Martin et al. | |
| 6,557,846 | B2 | 5/2003 | Martin et al. | |
| 6,986,635 | B2 | 1/2006 | Talken et al. | |
| 7,052,009 | B2 | 5/2006 | Roth | |
| 7,104,747 | B2 | 9/2006 | Talken et al. | |
| 7,416,073 | B1 | 8/2008 | Talken et al. | |
| 7,887,040 | B2 | 2/2011 | Roth | |
| 2004/0245071 | A1 | 12/2004 | Giffin | |
| 2004/0251603 | A1 | 12/2004 | Roth | |
| 2011/0285080 | A1 | 11/2011 | Gendreau et al. | |

FOREIGN PATENT DOCUMENTS

| | | | |
|---|---|---|---|
| DE | 23 43 678 | | 3/1975 |
| DE | 39 38 536 | | 6/1990 |
| DE | 198 17 064 | | 4/1999 |
| DE | 10 2004 029037 | | 12/2005 |
| EP | 0 150 655 | | 8/1985 |
| EP | 0 173 959 | | 3/1986 |
| EP | 0 876 979 | | 11/1998 |
| EP | 1 072 548 | | 1/2001 |
| FR | 2710042 | | 3/1995 |
| JP | 60220753 | | 11/1985 |
| JP | 60220753 | A * | 11/1985 |
| JP | 5058530 | | 3/1993 |
| JP | 2006 044858 | | 2/2006 |
| WO | WO 92/06914 | | 4/1992 |
| WO | WO 99/00305 | | 1/1999 |

* cited by examiner

SHEET DECELERATION APPARATUS AND METHOD

CROSS-REFERENCE TO RELATED APPLICATIONS

This application claims benefit of priority to U.S. Provisional No. 61/323,728 filed on Apr. 13, 2010, the contents of which are incorporated by reference in its entirety.

FIELD OF THE INVENTION

The present disclosure relates generally to a sheet deceleration apparatus and method and more specifically to a sheet deceleration apparatus and method for use in controlling the speed of a sheet of corrugated board or other sheet material as it leaves the entry or line conveyor and enters a stacking hopper.

BACKGROUND OF THE INVENTION

Sheets of corrugated board, paperboard, fiberboard or other sheet material are conventionally conveyed to a stacking hopper on an entry or line conveyor. In some cases, the sheets are overlapped or shingled, while in other cases, gaps in the direction of movement are provided between adjacent sheets. Overlapping or shingling of sheets is often undesirable. For example, because shingling results in conveyance of a solid stream of sheets, sensor identification of the location of individual sheets and the presence of jams or misalignments along the conveying path can be difficult. Moreover, the shingling of sheets results in a higher sheet density along the conveyor (i.e., number of sheets per unit area of conveyor), which may result in an increase in the occurrence of jams as well as increase in the number of sheets involved in the jams. Still further, because many of the sheets have flaps or other protrusions at their leading edges, shingling of sheets can be problematic.

Typically, the sheets are projected off the end of the entry conveyor and over a stacking hopper. The stacking hopper includes a generally vertical backstop and a forwardly positioned back tamper to define a bin or area to receive the sheets in stacked form. The capacity of a particular sheet stacking apparatus is determined by the number of sheets that can be stacked per unit of time. In general, this is directly related to the speed of the entry conveyor. The greater the speed of the entry conveyor, the greater the number of sheets that can be stacked in a unit of time, and thus the greater the stacking capacity of the sheet stacking apparatus. As the speed of the entry conveyor is increased, however, the sheets are projected over the stacking hopper and against the backstop at an increased speed. At elevated speeds beyond a certain speed (usually about 300 feet per minute for certain sheets), the projection against the backstop results in the sheet bouncing back toward the entry conveyor and/or possible damage to protruding tabs or flaps on the leading edge of the sheet. Accordingly, without deceleration means, a sheet stacker has a certain maximum effective operational speed.

To improve the capacity of the stacker beyond that point, it is necessary to decelerate or slow the speed of the sheets as they leave the entry conveyor and before they reach the backstop. The prior art includes various deceleration apparatus that function to decelerate or slow the speed of the sheets in this region. One such prior art machine utilizes a set or pair of spatially fixed nip rollers at the end of the entry conveyor and prior to the stacking hopper. In this particular apparatus, the nip rollers are positioned on opposite sides of the sheet and are designed to run or be driven at the entry conveyor line speed for most of the length of the sheet. As the trailing edge of the sheet approaches these rollers, they are decelerated to a desired lower speed to slow the sheet. After the sheet has passed, the rollers are accelerated back to line speed before the next sheet arrives. A limitation of this apparatus includes the physical limitations of ramping the rollers up to about 1,000 feet per minute or more and then back down to about 500 feet per minute or less at least three times per second. A further limitation or disadvantage includes machine wear and tear associated with this repeated high speed acceleration and deceleration.

A further deceleration apparatus, such as that disclosed in U.S. Pat. No. 7,052,009, titled "Sheet Deceleration Apparatus and Method," issued May 30, 2006, and incorporated by reference herein in its entirety, utilizes a pair of rollers moveable toward and away from one another to nip the sheet traveling between them. Specifically, this method involves delivering a sheet between the pair of rollers and moving the rollers toward one another to nip, and thus decelerate, the sheet as it enters the area of the stacking hopper.

Yet another deceleration apparatus utilizes an overhead vacuum to transport the sheet into the hopper area. This machine ramps the speed of the vacuum conveyors down to zero, kicks off the end sheet over the hopper, and then ramps back up to line speed. Although this machine is acceptable at lower speeds, it is expected that it would have drive problems at higher speeds. A combination of the deceleration apparatus of U.S. Pat. No. 7,052,009 and various embodiments of overhead vacuum means is further described in U.S. patent application Ser. No. 12/351,496, titled "Sheet Deceleration Apparatus and Method," filed Jan. 9, 2009, which is incorporated by reference herein in its entirety.

Accordingly, there is a continuing need in the art for a sheet deceleration apparatus and method which overcomes the limitations in the art and provides a deceleration method and apparatus capable of increasing the stacking capacity of a sheet stacker. Additionally, there is a continuing need in the art for a sheet deceleration apparatus and method that can lower complexity and/or part count, increase reliability, lower power requirement, and/or allow faster conveyor line speeds.

BRIEF SUMMARY OF THE INVENTION

The present disclosure is directed to a sheet deceleration apparatus and method that has particular application for use in a sheet stacking apparatus for stacking sheets of corrugated board, paperboard, fiberboard, or other sheet material from an entry or line conveyor or other delivery means. In one embodiment, the present disclosure relates to a sheet deceleration apparatus for reducing the speed of a sheet of material moving along a travel path at a first speed. The deceleration apparatus includes a rotatable cam nip being rotatable about a first axis and provided on one side of the travel path so that the sheet of material can pass by the cam nip. The cam nip includes a lobe end, such that when the lobe end is away from the travel path, the sheet of material can pass substantially unimpeded past the cam nip, and when the lobe end is near the travel path, the sheet of material is nipped by the cam nip decelerating the sheet of material from the first speed to a second speed.

In another embodiment, a method aspect of the present disclosure includes delivering a sheet of material past a cam nip, the cam nip being rotatable on a first axis and driving rotation of the cam nip, such that when a lobe end of the cam nip is away from the travel path, the sheet of material can pass substantially unimpeded past the cam nip, and when the lobe end is near the travel path, the sheet of material is nipped by the cam nip decelerating the sheet of material from the first speed to a second speed.

In yet another embodiment, the present disclosure relates to a sheet stacking apparatus having an entry conveyor, a stacking hopper, and a sheet deceleration apparatus. The entry conveyor delivers sheets of material along a travel path toward a discharge end of the entry conveyor. The stacking hopper is positioned downstream from the entry conveyor. The deceleration apparatus includes a rotatable cam nip being rotatable about a first axis and provided on one side of the travel path so that the sheet of material can pass by the cam nip. The cam nip includes a lobe end, such that when the lobe end is away from the travel path, the sheet of material can pass substantially unimpeded past the cam nip, and when the lobe end is near the travel path, the sheet of material is nipped by the cam nip decelerating the sheet of material from the first speed to a second speed.

While multiple embodiments are disclosed, still other embodiments of the present disclosure will become apparent to those skilled in the art from the following detailed description, which shows and describes illustrative embodiments of the invention. As will be realized, the various embodiments of the present disclosure are capable of modifications in various obvious aspects, all without departing from the spirit and scope of the present disclosure. Accordingly, the drawings and detailed description are to be regarded as illustrative in nature and not restrictive.

BRIEF DESCRIPTION OF THE DRAWINGS

While the specification concludes with claims particularly pointing out and distinctly claiming the subject matter that is regarded as forming the various embodiments of the present disclosure, it is believed that the invention will be better understood from the following description taken in conjunction with the accompanying Figures, in which:

DETAILED DESCRIPTION

Figure 1:
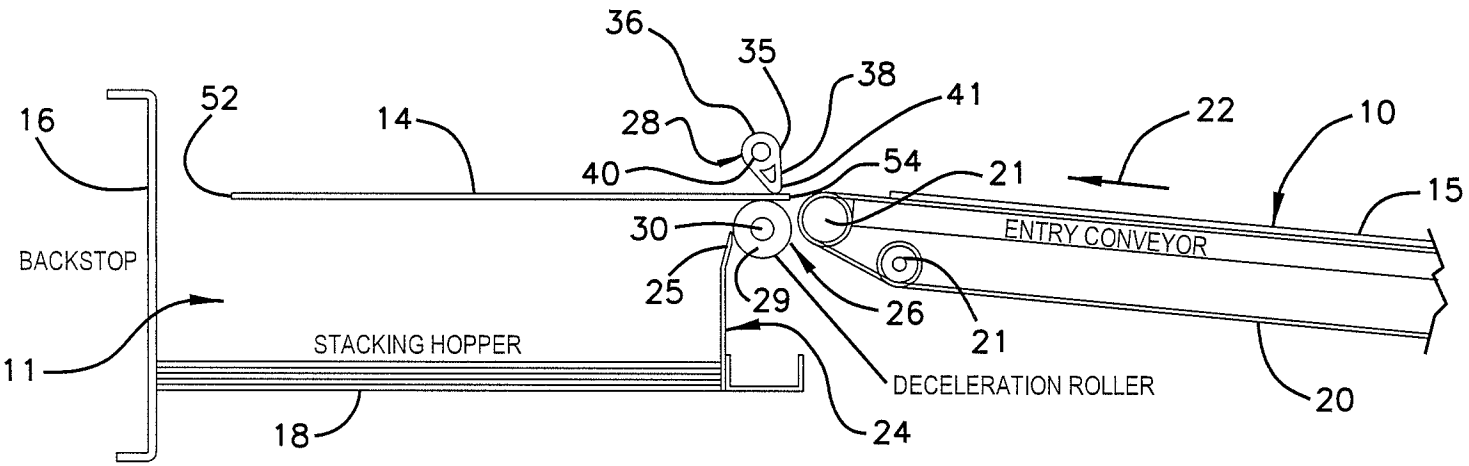
FIG. 1 is an elevational side view of a schematic of a deceleration apparatus in accordance with one embodiment of the present disclosure showing a sheet as it is being decelerated.

The various embodiments of deceleration apparatus and methods in accordance with the present disclosure may be used with a sheet stacking machine of the type having an entry conveyor or other sheet delivery means and a stacking hopper. With specific reference to FIG. 1, a sheet stacking machine of one embodiment may include an entry conveyor 10 and a stacking hopper 11. During normal operation, a series of sheets 14, 15, etc. may be conveyed by the entry conveyor 10 along a travel path toward the stacking hopper 11. As they reach the discharge end of the entry conveyor 10, the sheets 14, 15, etc. may be projected toward the backstop 16 (which may also be referred to in industry as a stop plate or front plate) of the stacking hopper 11. The projected sheets may strike the backstop and fall into the hopper where they accumulate in a stack of sheets 18. The series of sheets 14, 15, etc. may be separated in the direction of movement by a gap, which may a constant or variable distance among the series of sheets. With this structure, the sheets delivered by the entry conveyor 10 may be formed into stacks 18 of sheets for delivery to a site for further processing or storage.

As will be understood, the sheets 14, 15, etc. may be comprised of a pair of sheets spaced laterally from one another and being conveyed along the conveyor 10 and through the deceleration mechanism (described below) in a synchronized manner. In other embodiments, it is recognized that the sheets may be comprised of any suitable number of laterally spaced sheets, including one, two, three, four, or more sheets spaced laterally from one another. Each of the sheets 14, 15, etc. may include a leading edge 52 and a trailing edge 54. The leading edge 52 may be the front or leading edge of the sheets as they travel along the conveyor in the direction of the arrow 22, while the trailing edge 54 may be the back or trailing edge of the sheets as they travel along the conveyor 10 in the direction of the arrow 22. In FIG. 1, the sheet 14 may be an example of a sheet which has been projected from the conveyor 10.

It will be understood that the stacking machine may be operable up to a certain maximum effective entry conveyor speed. If the speed of the entry conveyor 10 exceeds the maximum operational speed, the momentum of the sheets that are projected from the end of the conveyor 10 may carry the sheets against the backstop 16 with excessive force. This can cause the sheets to bounce back toward the conveyor, resulting in the machine being jammed or the sheets being misaligned or skewed in the stack 18. Projecting the sheets at excessive speeds against the backstop 16 can also result in damage to the leading edge of the sheet. This may particularly be the case if the leading edge includes, for example, flaps, tabs, or other protrusions. Accordingly, the sheet stacking machine may have a certain maximum operational entry conveyor speed (normally defined in terms of feet per minute and often about 500 feet per minute for certain sheet types) within which the stacking machine is operational for a sheet of a given size.

To improve the capacity of the sheet stacking machine by increasing the speed of the entry conveyor beyond its normal maximum speed, it may be desirable to slow down or decelerate the sheets as they are projected from the entry conveyor to an acceptable speed. This acceptable speed may be a speed that will not cause the sheets to bounce back or result in damage to the leading edges of the projected sheets. The various deceleration means, which are the subject of the present disclosure, and further details of the sheet stacking machine and system are described with reference to FIGS. 1-9.

In one embodiment, the entry conveyor 10 may be a belt conveyor. Although the conveyor 10 could comprise a single belt extending across the width of the apparatus, the conveyor 10 in one preferred embodiment may be comprised of a plurality of laterally spaced individual belt conveyors or belt conveyor sections. These conveyor sections may be laterally spaced from one another and include an endless belt 20. Each of the belts 20 may be supported by a plurality of belt support rollers 21. At least one of the rollers may be driven to provide the conveyor 10 with its belt or line speed. The belts 20 may move in unison to convey the sheets 14, 15, etc. along the conveyor and toward the stacking hopper 11 in the direction indicated by the arrow 22. The belts 20 may be conventional conveyor belts used in the corrugated, paperboard, or other sheet conveyance industry. Although one embodiment shows a sheet stacking machine comprising endless belts as the entry conveyor and as the means for delivering the sheets to the stacking hopper, other means currently known in the art, or which may be made available in the art, to transport or convey sheets may be used as well. Such other means do not alter the advantageous features of the deceleration apparatus and method of the present disclosure. Such other means may include rollers, overhead or underneath vacuum transport mechanisms, newspaper clamp conveying mechanisms, or any other suitable conveyance or delivery means. Such other means could also comprise top and bottom belts with the sheets sandwiched between them.

It should be noted that the entry conveyor 10, as shown in FIG. 1, is sloped upward toward the stacking hopper 18. In other embodiments the entry conveyor 10 may be substantially horizontal as it approaches the stacking hopper or may be sloped at any other suitable angle, for example, in situations where elevation at the front end of the conveyor is desirable or necessary.

The stacking hopper 11 may include a backstop 16, which is spaced from the forward end of the entry conveyor 10. The distance of this spacing may be adjustable to accommodate sheets of different lengths and may be at least as great as the length of the sheets (measured in the direction of travel) being stacked. The stacking hopper 11 may also include a back tamper 24 extending generally parallel to the backstop 16. As shown, the back tamper may include a generally vertical wall portion and an upper edge 25, which may be sloped toward the entry conveyor 10. This sloping edge 25 may assist in guiding the projected sheets into the stacking hopper 11 between the backstop 16 and the back tamper 24. This back tamper may be of a conventional design and include structure to square the stack 18 and to repeatedly tamp the rear edges of the sheets in the stack toward the backstop 16 to keep the stack 18 square during the stacking process. The stacking hopper 11 may also be provided with one or more side tampers and a divider if multiple side-by-side sheets are being stacked. In one embodiment, the back tamper may be spaced from the entry conveyor 10 a sufficient distance to accommodate the sheet deceleration apparatus of the present disclosure.

In one embodiment, the sheet deceleration apparatus of the present disclosure may include a first decelerator 26 and a nip or second decelerator 28. While discussed herein as typically including a first decelerator and a second decelerator, it is understood that in some embodiments, the first decelerator 26 may be eliminated, and the second decelerator 28 may provide sheet deceleration without nipping the sheets 14, 15 against a first decelerator, as is described more fully below. Where a first decelerator 26 is provided, the decelerator 26 may be positioned below or on one side of the sheet travel path, for example, on the underneath side of the sheet travel path as shown in FIG. 1, while the nip or second decelerator 28 may be positioned above or on the other side of the sheet travel path. However, in other embodiments, the decelerator 26 may be positioned above the sheet travel path, while the nip or second decelerator 28 may be positioned below the sheet travel path. The first decelerator 26 and nip or second decelerator 28 may be designed to temporarily nip or capture a projected sheet 14 to slow down or decelerate the forward travel speed of that sheet. This may permit the entry conveyor 10 to travel at an increased speed (e.g., 1000 feet per minute or faster), while at the same time preventing the sheets from being projected against the backstop at excessive speeds that would cause the sheets to bounce back or damage to the leading edge of the sheets.

The decelerator 26 may include one or more skids or skid plates, rollers, or any other suitable apparatus for assisting in contacting, guiding, and/or decelerating the passing sheets 14, 15. In one embodiment, the decelerator 26 may include a plurality of laterally spaced deceleration rollers 29 positioned on one side of the projected sheet 14. In one embodiment, the rollers 29 may be mounted on a common rotation shaft 30 and spaced from one another laterally across the width of the entry conveyor 10 (see, e.g., FIG. 6). The shaft 30, and thus the rotation axis of the rollers 29, may be generally perpendicular to the travel path of the sheets. As shown in FIG. 1, the rollers 29 may be positioned generally at the forward end of the entry conveyor 10. In one embodiment, the rollers 29 may be spaced slightly in front of the forward end of the entry conveyor 10, with the top of the rollers 29 being at the conveying level of the conveyor 10. In a further embodiment, the top of the rollers 29 may be slightly below the conveying level of the conveyor 10 (the sheet travel path). This may result in the projected sheet dropping slightly as it is engaged by the nip (discussed below) and may eliminate or minimize interference by the leading edge of the following sheet.

The rollers 29 may also be positioned slightly rearwardly of the back tamper 24. This may permit the projected sheets to fall within the stacking hopper 11 without interference from the rollers 29. The rollers 29 may be mounted to the common shaft 30 for rotation with the shaft 30. In one embodiment, the shaft 30, and thus the rollers 29, may be driven, although some advantages of the present invention may be achieved with rollers 29 that are free spooled or that are provided with a specified rotational resistance. The rollers may be driven at a rotational speed such that the circumferential speed of the outer surface of the rollers 29 travels in the same direction as the travel direction 22 of the conveyor 10, but at a reduced speed. For example, the rotational speed of the shaft 30 and rollers 29, and thus the degree of deceleration, may be adjusted so that the circumferential speed of the rollers is about one-half to one-fourth the linear speed of the conveyor 10. The circumferential speed of the rollers may also be greater than one-half the linear speed of the conveyor 10, or it may be less than one-fourth the linear speed of the conveyor 10. The degree of deceleration can be any fraction (less than one) of the line speed of the conveyor 10. In such embodiments, the shaft 30 and thus the rollers 29 may be driven by a deceleration roller motor 90 (see FIG. 6). In one embodiment, this motor may be a variable speed or variable frequency motor designed to run at a plurality of adjustable constant or variable speeds. These speeds may be sufficient to rotate the rollers 29 at a circumferential speed (feet per minute) less than the linear speed at which the sheets are traveling on the conveyor 10. In an alternative embodiment, the speeds may be sufficient to rotate the rollers 29 at a circumferential speed (feet per minute) greater than the linear speed at which the sheets are traveling on the conveyor 10 and, thus, the decelerator 26 may function as an accelerator.

In some embodiments, the sloping wall section 25 of the back tamper 24 may be provided with a plurality of cutout portions or recesses to accommodate nesting of the rollers in those recesses. These recesses may be aligned with the rollers 29 and may permit the tamping movement of the tamper 24 without interference between the wall 25 and the rollers 29.

The position of the shaft 30 relative to the entry conveyor 10 may be spatially fixed during an operational mode. It is also contemplated, however, that means may be provided, if desired, to adjust the vertical and lateral position of the shaft 30 and thus the rollers 29 relative to the forward end of the entry conveyor 10.

The rollers 29, or alternatively skid plates, etc., can be made from a variety of materials. In one embodiment, these may include aluminum or aluminum with a urethane coating. Various plastics and other materials or combinations of materials may be used as well.

In one embodiment, the nip or second decelerator 28 may provide a rotational pinch, instead of a linear pinch. As illustrated in FIG. 1, the nip or second decelerator 28 may include a lobe-tipped or generally round-tipped cam nip 35 having a shaft connection end or point 36 and a lobe end 38. In one embodiment, the cam nip 35 may be generally tear-drop shaped, but it is recognized that any other shape providing a nip end or multiple nip ends may be used. For example, cam nip 35 may be triangular, having three nip ends, square-ish, having four nip ends, star-shaped, having five nip ends, etc. Similarly, the connection end 36 may have any shape, and in some embodiments, may be a generally centrally located area between multiple nip ends; in a generally tear-drop shaped embodiment, such as shown in FIG. 1, a generally simple round shape may be preferred, but any suitable shape may also be used for the connection end 35 of this embodiment. As with the rollers 29, the cam nip 35 can be made from a variety of materials. In one embodiment, these may include aluminum or aluminum with a urethane coating. Various plastics and other materials or combinations of materials may be used as well. The connection end 36 may include a central opening for receiving and securing to a rotation shaft 40. The lobe end 38 may extend away from the connection end 36 and rotation shaft 40 a suitable distance to end in a generally roundish tip 41. Accordingly, as the cam nip 35 is caused to rotate via the rotation shaft 40, the lobe end 38 may be designed to, for each rotation of the cam nip 35, temporarily nip or capture a projected sheet 14 between the tip 41 of the lobe end 38 and a deceleration roller 29 (or skid plate) to slow down or decelerate the forward travel speed of that sheet.

Figure 2:
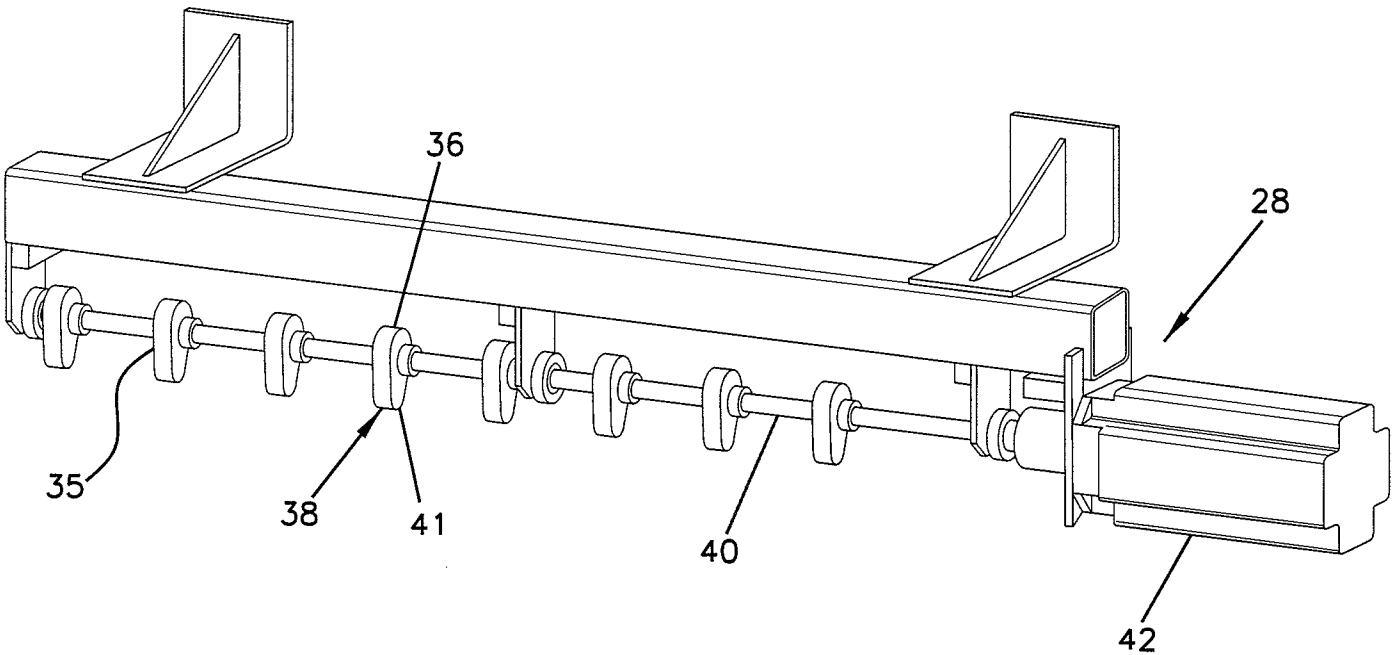
FIG. 2 is an isometric view of a nip or second decelerator in accordance with one embodiment of the present disclosure.

As shown in FIG. 2, the nip or second decelerator 28 may include a plurality of individual cam nips 35. As shown, these cam nips 35 may be laterally spaced across a common rotation shaft 40 and may extend the width of the entry conveyor 10. In further embodiments, such spacing may approximate the spacing of the rollers 29. Accordingly, each of the rollers 29, in one embodiment, may include an associated or complimentary cam nip 35. The lobe ends 38 may be zero crush nips, which may help eliminate or minimize any damage to the sheet as it is engaged by the lobe ends 38.

The rotation shaft 40 may be connected with and driven by a servo motor 42 or other suitable drive mechanism. The servo motor 42 may be a conventional servo motor, which is synchronized with the speed of the entry conveyor 10, the press, and/or other components of the conveyance and processing system. The synchronized servo motor may be ensure that the rotational movement of the cam nips 35 and their respective lobe ends 38 in cooperation with the rollers 29 engage or nip the projected sheet at the desired point in time (relative to the projected sheet 14) and for the desired length of time to decelerate the sheet from the line speed of the conveyor 10 to a desired lower speed. The position of the shaft 40 relative to the rollers 29 may be spatially fixed during an operational mode. It is also contemplated, however, that means may be provided, if desired, to adjust the vertical position of the shaft 40 and thus the nip decelerators 28 relative to the rollers 29. In this manner, the position of the nip decelerators 28 may be adjusted to accommodate, for example, sheets of varying thickness, increase/decrease of nip pressure, and the like.

As shown in FIG. 3*a-e*, a sheet deceleration apparatus of the present disclosure may further include a sensor or sensing means 60, such as but not limited to one or more photodetectors or laser sensors, which may be used to track the sheets 15 as they are conveyed along the entry conveyor 10 towards the stacking hopper 11. In one embodiment, the sensing means 60 may be used to determine the leading and/or trailing edges of the passing sheets 15. Further sensing means 60 may include a mechanical timers configured for detecting the presence of sheets at predetermined locations on the conveyor and actuating the nip decelerator 28 after some predetermined period and/or in some predetermined interval. Alternatively, or in addition, sensing means 60 may include an electronic timer for operatively directing the nip decelerator 28, such as based on the spacing and line speed of the sheets, and/or based on a signal that is correlated to the sheets' positions and/or timing on the conveyor. The predetermined periods and/or intervals may be determined, for example, on the basis of the dimensions of the sheets, the speed of the conveyor, and the like.

In an alternative embodiment, in lieu of the nip decelerator 28, any mechanism for urging the sheets downward into frictional contact with the rollers 29 may be provided without deviating from the spirit of the present disclosure. For example, a forced air generator may be positioned above the rollers 29 and configured to direct a burst of air to a portion of a sheet passing directly over the rollers 29 with a force sufficient to decelerate the sheet. As an additional example, the nip decelerator 28 may be replaced with a piston rod-type device that includes a shaft oriented perpendicularly to the conveyor having a first end for contacting the sheets and a second end coupled to a wheel that is rotatable to drive the shaft.

In some embodiments, a sheet deceleration apparatus of the present disclosure may additionally include a forced air generator configured to provide a flow of air from above and proximate the nip decelerator 28 and/or the hopper 11. The forced air generator may be in the form of a fan, blower, or the like. The forced air generator may be configured to produce a flow of air that urges the sheets downward and toward the hopper 11 as they are passed from the deceleration apparatus to the hopper 11. In this manner, increased control of the sheets may be maintained as the sheets are deposited into the hopper 11.

Figure 3A:
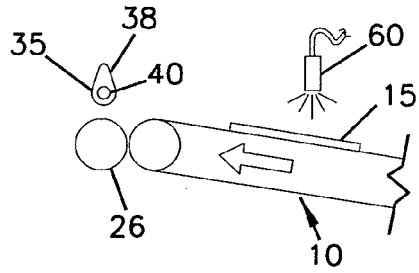
FIG. 3*a-e* are schematic diagrams illustrating a method of sheet deceleration in accordance with one embodiment of the present disclosure.
Figure 3B:
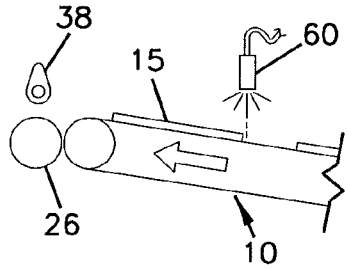
Figure 3C:
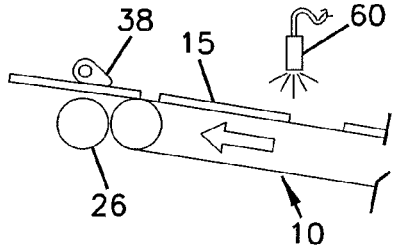
Figure 3D:
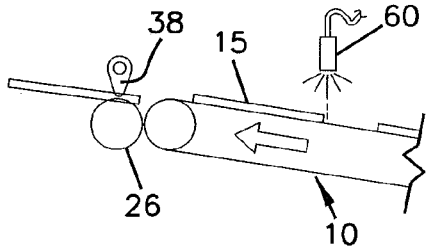
Figure 3E:
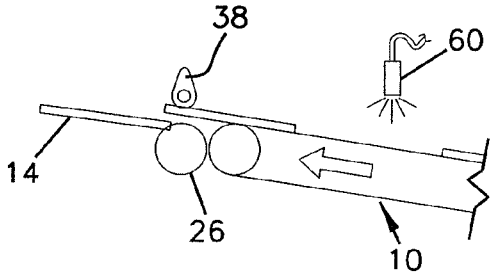

Having described the structural details of the deceleration apparatus in accordance with the present disclosure, the operation of that apparatus and the method aspect of the present disclosure can be understood and described as follows, with reference to FIGS. 1 and 3*a-e*. During normal operation, a linear series of sheets, 14, 15, etc. may travel along the entry conveyor 10 (or otherwise be delivered at line speed) in the direction of the arrow 22. These sheets may include a gap between the trailing edge 54 of one sheet and the leading edge 52 of the adjacent following sheet. Because of the speed at which the conveyor 10 is moving, each sheet that reaches the end of the conveyor may be projected off the conveyor toward the backstop 16. For each cycle, the nip or second decelerator 28 may be initially positioned such that the cam nips 35 are in a ready position. In one embodiment, as shown in FIG. 3*a*, in the ready position, the lobe ends 38 of the cam nips 35 may face away from the nip rollers 29. While, FIG. 3*a* illustrates the lobe ends 38 in a position that is substantially up and away from the nip rollers, it is recognized that any other position where the cam nips 35 are not interfering with passing sheets may be considered the ready position. As shown in FIG. 3*a-e*, the sheet deceleration apparatus may track the sheets 15, e.g., using sensing means 60, as they convey along the entry conveyor 10 to the nip point. In one embodiment, as illustrated in FIG. 3*b*, the sensing means 60 may track the sheets, such as by determining the position of the leading and/or trailing edges of the sheets 15. This determination may be used to trigger a motion profile process, which initiates rotation of the rotation shaft 40, and thus cam nips 35, via the servo motor 42. As shown in FIGS. 1 and 3*c-d*, shortly before the leading edge of the projected sheet 14 reaches the backstop 16, the cam nips 35 may be rotated such that the lobe ends 38 are moved downwardly toward the deceleration rollers 29, creating a nip point to nip or capture the sheet between the lobe ends 38 of the cam nips 35 and the rollers 29. This rotational movement of the cam nips 35 moving the lobe ends 38 toward the deceleration rollers 29 may be at a point in time relative to the projected sheet 14 where it nips or captures the projected sheet, generally near its trailing edge 54 or as close to its trailing edge as possible. When the sheet is nipped or captured between the lobe ends 38 of the cam nips 35 and the deceleration rollers 29, the sheet may be held long enough to decelerate it from a line speed to a stacking speed, in some cases decelerating the sheet to a speed approximating that of the deceleration roller. After the sheet has decelerated sufficiently, the rotation shaft 40 may continue rotating via the servo motor 42 until the cam nips 35 are returned to a ready position, such as shown in FIG. 3*e*, thus releasing the sheet to continue on at its decelerated rate toward or into the stacking hopper 11. The cam nips 35 may generally be rotated at a rate that allows the leading edge of the next sheet to enter the nip zone substantially without interference, and the process begins on the next cycle. It is to be appreciated that the foregoing operation and method aspect of the present disclosure provides rapid deceleration of the sheets from the line speed to the stacking speed.

Figure 4:
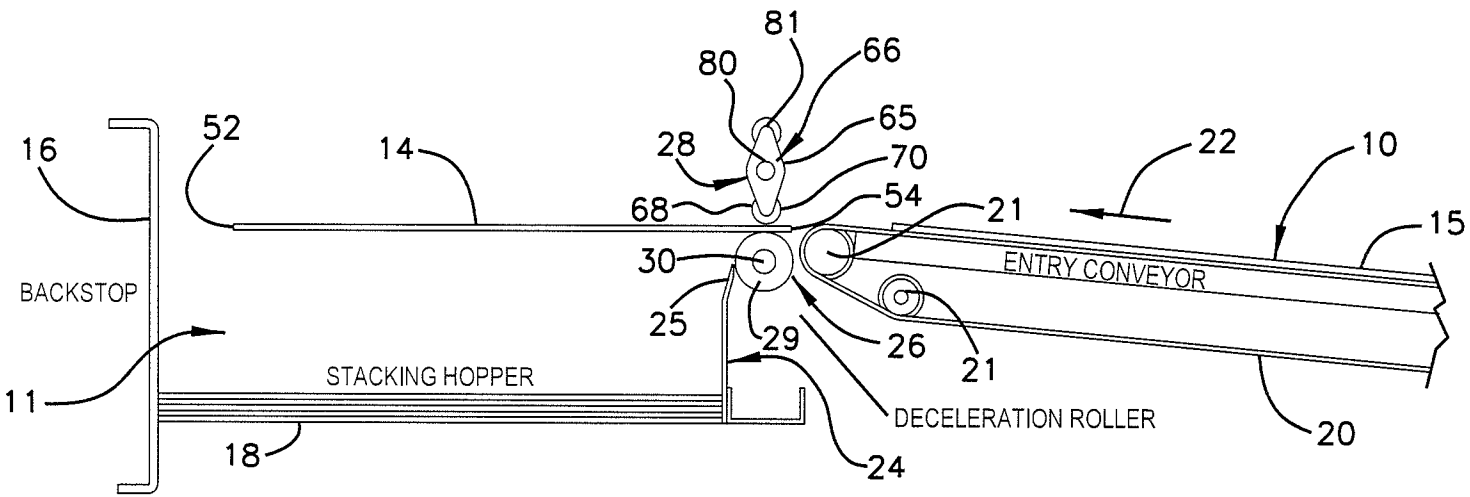
FIG. 4 is an elevational side view of a schematic of a deceleration apparatus in accordance with another embodiment of the present disclosure showing a sheet as it is being decelerated.
Figure 5:
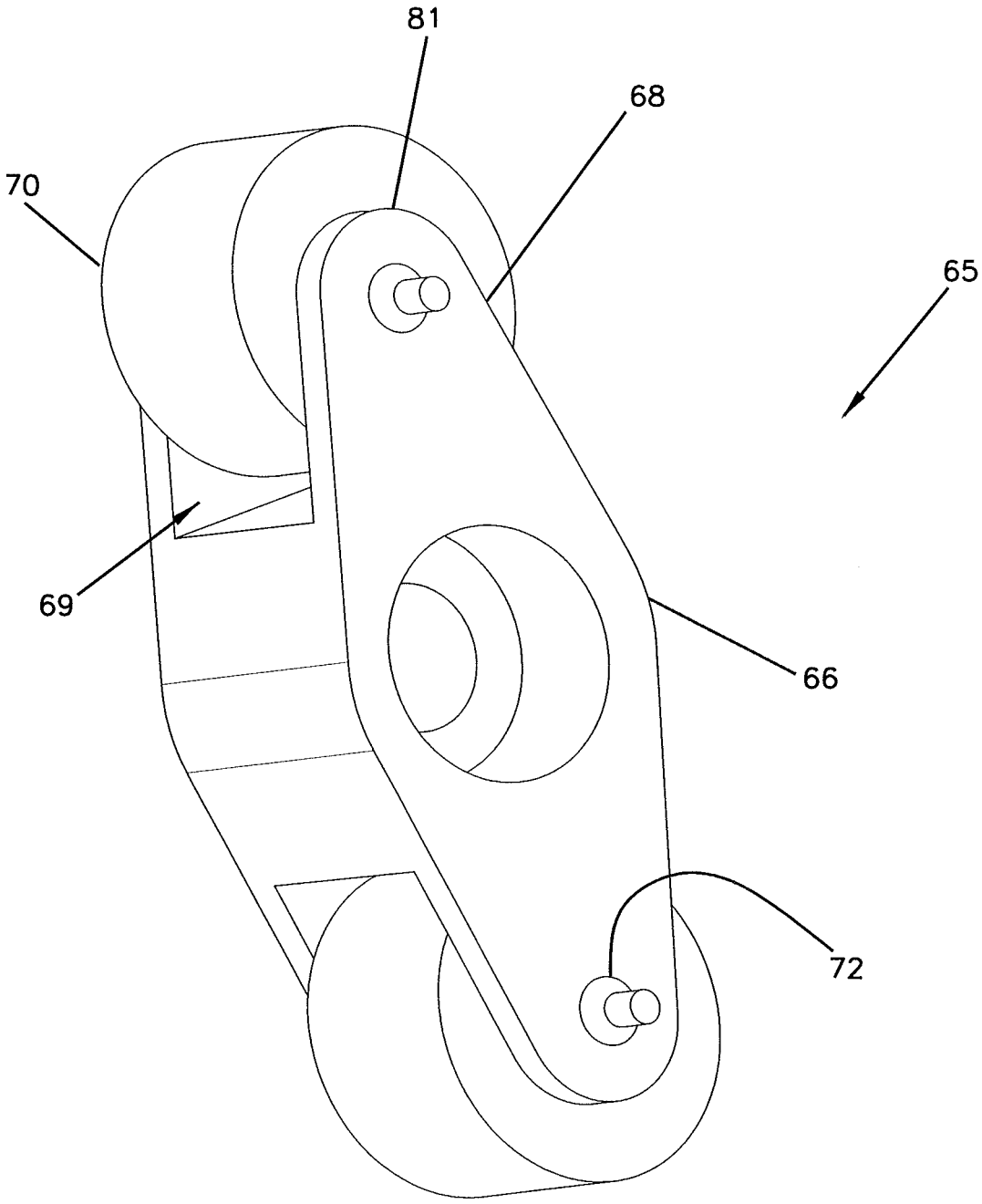
FIG. 5 is an isometric view of a cam nip of a deceleration apparatus in accordance with one embodiment of the present disclosure.

In another embodiment, illustrated in FIGS. 4 and 5, the nip or second decelerator 28 may include a cam nip 65 having a shaft connection point 66 and a lobe end 68 having a slot area 69 with a rotatable nip wheel 70 positioned at least partially therein. In a further embodiment, as illustrated in FIGS. 4 and 5, the cam nip 65 may have two lobe ends 68, each having a slot area 69 and corresponding rotatable nip wheel 70 positioned at least partially therein, and it is recognized that the cam nip 65 could have additional lobe ends and nip wheels 70, where desirable. Accordingly, in one embodiment, the cam nip 65 may be generally diamond shaped, with a rotatable nip wheel 70 at each end, but it is recognized that any other suitable shape may be used. As with the rollers 29 and cam nip 35, cam nip 65 and nip wheels 70 can be made from a variety of materials. In one embodiment, these may include aluminum or aluminum with a urethane coating. Various plastics and other materials or combinations of materials may be used as well. The connection point 66 may include a central opening for receiving and securing to a rotation shaft 80. The lobe ends 68 may extend away from the connection point 66 and rotation shaft 80 a suitable distance to end in a generally roundish tip 81. In the area of tip 81, the lobe ends 68 may each include a slot area 69 where nip wheels 70 may be rotatably coupled with, for example, rods or posts 72, which in some embodiments, may be simple bolts or the like, extending across the slot areas 69, and generally through the center of the nip wheels 70. Accordingly, as a cam nip 65 is caused to rotate via the rotation shaft 80, each lobe end 68 may be designed to, for each rotation of the cam nip 65, temporarily nip or capture a projected sheet 14 between the corresponding nip wheel 70 of the lobe end 68 and a deceleration roller 29 (or skid plate) to slow down or decelerate the forward travel speed of that sheet. As will be recognized from the description and figures, in embodiments with two lobe ends 68 and corresponding wheels 70, for example, the cam nip 65 may be designed so that each half rotation of the cam nip 65 temporarily nips or captures a projected sheet 14 between the corresponding nip wheel 70 of a lobe end 68 effectively decelerating a passing sheet. Accordingly, in some embodiments, only a half rotation of the cam nip would be needed per passing sheet 14.

Figure 6:
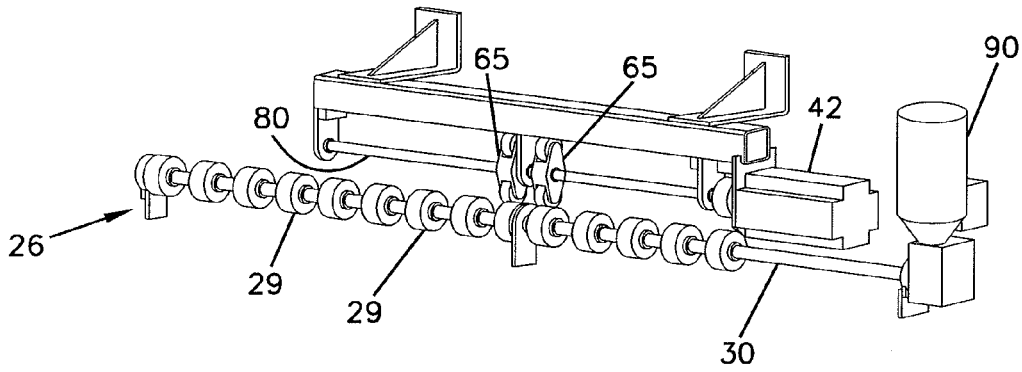
FIG. 6 is an isometric view of a first decelerator and a nip or second decelerator of a deceleration apparatus in accordance with one embodiment of the present disclosure.
Figure 7:
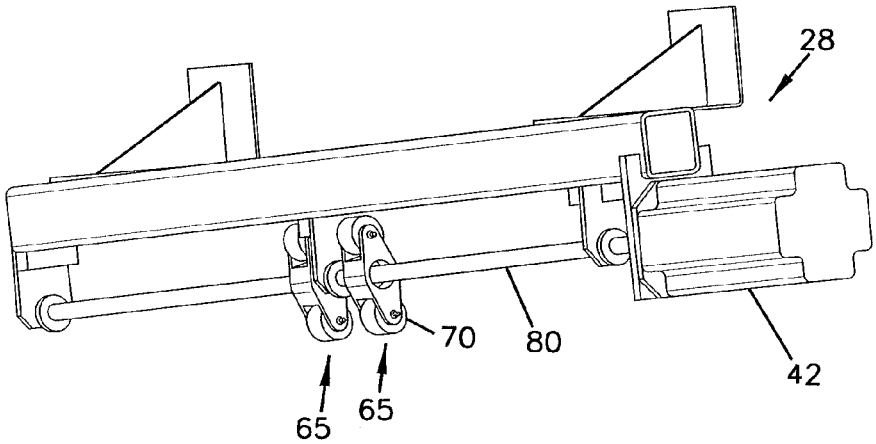
FIG. 7 is an isometric view of a nip or second decelerator in accordance with one embodiment of the present disclosure.

As shown in FIGS. 6 and 7, the nip or second decelerator 28 may include two or more individual cam nips 65. As shown, these cam nips 65 may be laterally spaced across a common rotation shaft 80. While FIGS. 6 and 7 illustrate only two cam nips 65, it is recognized that any suitable number of cam nips 65 may be used, and, for example, may be laterally spaced so as to extend the width of the entry conveyor 10, similar to the cam nips 35 shown in FIG. 2. In further embodiments, such spacing may approximate the spacing of the rollers 29. Accordingly, some or each of the rollers 29, in one embodiment, may include an associated or complimentary cam nip 65. The nip wheels 70 at lobe ends 68 may be zero crush wheels, which may help eliminate or minimize any damage to the sheet as it is engaged by the nip wheels 70.

The rotation shaft 80 may be connected with and driven by a servo motor 42 or other suitable drive mechanism, such as described above. The servo motor 42 may be a conventional servo motor, which is synchronized with the speed of the entry conveyor 10, the press, and other components of the conveyance and processing system. The function of the synchronized servo motor may be to ensure that the rotational movement of the cam nips 65 and their respective lobe ends 68 and corresponding nip wheels 70 in cooperation with the rollers 29 engage or nip the projected sheet at the desired point in time (relative to the projected sheet 14) and for the desired length of time to decelerate the sheet from the line speed of the conveyor 10 to a desired lower speed.

Figure 8A:
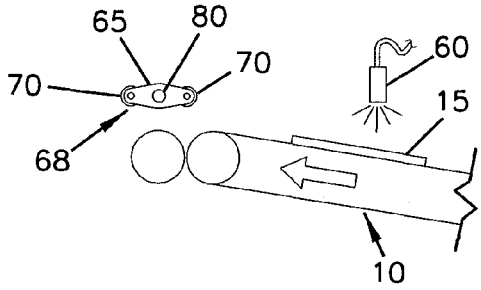
FIG. 8*a-e* are schematic diagrams illustrating a method of sheet deceleration in accordance with one embodiment of the present disclosure.
Figure 8B:
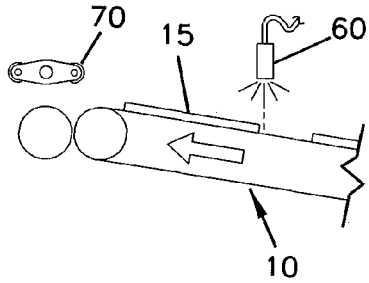
Figure 8C:
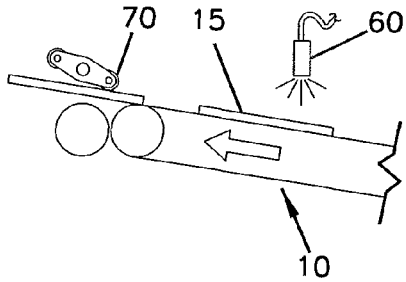
Figure 8D:
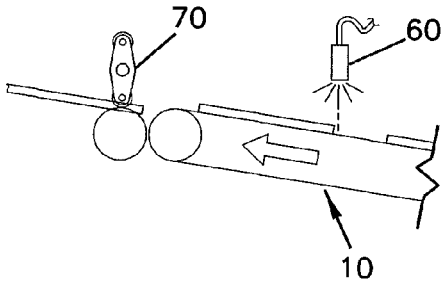
Figure 8E:
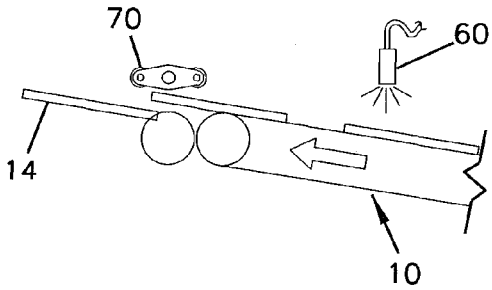

Operation of the sheet deceleration apparatus of FIG. 4 and the method aspect of the present disclosure may be similar to operation of the sheet deceleration apparatus of FIG. 1 and can be understood and described as follows, with reference to FIGS. 4 and 8*a-e*. During normal operation, a linear series of sheets, 14, 15, etc. may travel along the entry conveyor 10 (or otherwise be delivered at line speed) in the direction of the arrow 22. These sheets may include a gap between the trailing edge of one sheet and the leading edge of the adjacent following sheet. Because of the speed at which the conveyor 10 is moving, each sheet that reaches the end of the conveyor may be projected off the conveyor toward the backstop 16. For each half cycle, the nip or second decelerator 28 may be initially positioned such that the cam nips 65 are in a first ready position. In one embodiment, as shown in FIG. 8*a*, in the first ready position, the lobe ends 68 of the cam nips 65 are away from the nip rollers 29. While FIG. 8*a* illustrates the lobe ends 68 positioned substantially in a horizontal plane, such that each lobe end 68 of a cam nip is generally an equal distance from the corresponding nip roller 29, it is recognized that any other position where the cam nips 65 are not interfering with passing sheets may be considered the ready position. As shown in FIG. 8*a-e*, the sheet deceleration apparatus may track the sheets 15, e.g., using sensing means 60, as they convey along the entry conveyor 10 to the nip point. In one embodiment, as illustrated in FIG. 8*b*, the sensing means 60 may track the sheets, such as by determining the position of the leading and/or trailing edges of the sheets 15. This determination may be used to trigger a motion profile process, which initiates rotation of the rotation shaft 80, and thus cam nips 65, via the servo motor 42. As shown in FIGS. 4 and 8*c-d*, shortly before the leading edge of the projected sheet 14 reaches the backstop 16, the cam nips 65 may be rotated such that one of the lobe ends 68 of each cam nip 65, generally the lobe ends nearer the entry conveyor 10, are moved downwardly toward the corresponding deceleration rollers 29, creating a nip point to nip or capture the sheet between the nip wheels 70 of the cam nips 65 and the rollers 29. This rotational movement of the cam nips 65 moving the lobe ends 68 and corresponding nip wheels 70 toward the deceleration rollers 29 may be at a point in time relative to the projected sheet 14 where it nips or captures the projected sheet generally near its trailing edge 54 or as close to its trailing edge as possible. When the sheet is nipped or captured between the nip wheels 70 of the cam nips 65 and the deceleration rollers 29, the sheet may be held long enough to decelerate it from a line speed to a stacking speed, in some cases decelerating the sheet to a speed approximating that of the deceleration roller, which may be determined, for example, by motor 90 illustrated in FIG. 6. After the sheet has decelerated sufficiently, the rotation shaft 80 may continue rotating via the servo motor 82 until the cam nips 65 are brought to a second ready position, such as shown in FIG. 3*e*, with the lobe ends 68 reversed in position from the first ready position, thus releasing the sheet to continue on at its decelerated rate toward or into the stacking hopper 11. The cam nips 65 may generally be rotated at a rate that allows the leading edge of the next sheet to enter the nip zone substantially without interference, and the process begins on the next half cycle.

Figure 9:
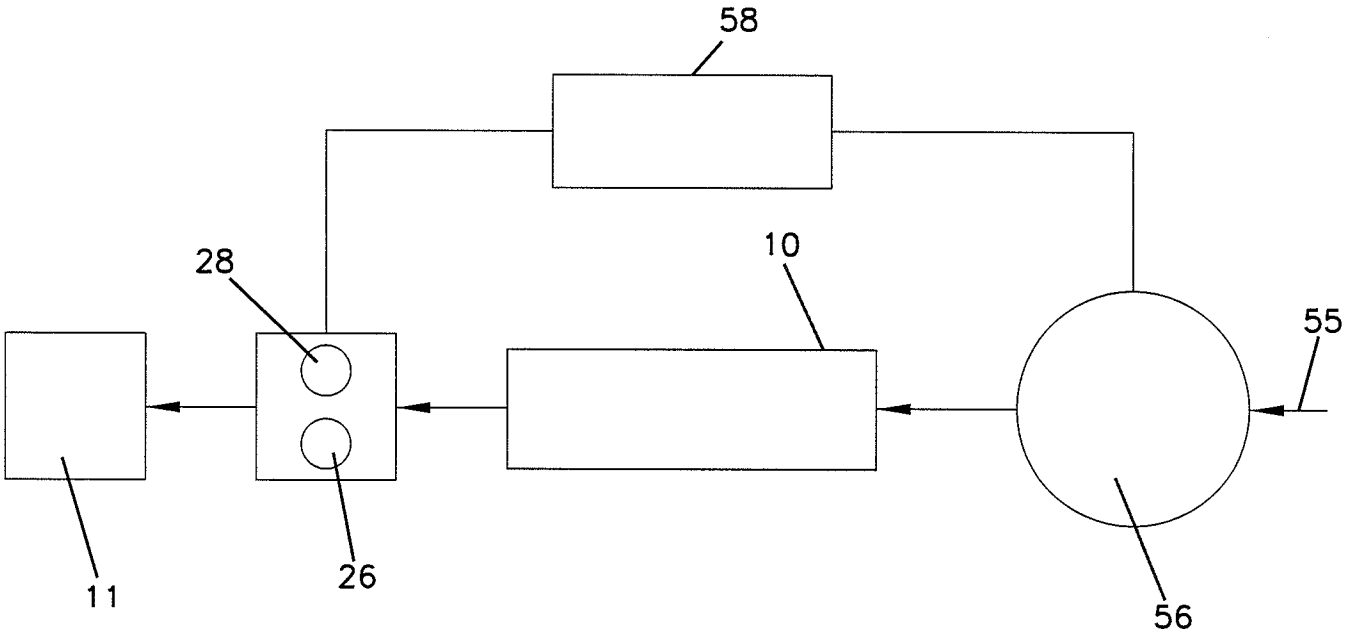
FIG. 9 is, a schematic flow diagram showing a sheet formation, delivery, deceleration, and stacking system utilizing a deceleration apparatus in accordance with the present disclosure.

Another system in which the various embodiments of deceleration apparatus and methods of the present invention may have particular application is illustrated schematically in FIG. 9. In such system, corrugated or other sheets of material may be cut from a web 55 of material by a rotary press or drum 56. Depending upon the length of the sheets, one revolution of the drum 56 conventionally may cut out three or six sheets (or more or less for specialty systems). In general, the sheets may be as long as 84 inches or more or as short as 10 inches or less. These sheets may be delivered to the entry conveyor 10 described above. The entry conveyor 10 may then deliver the sheets, with gaps between the trailing edge of one sheet and the leading edge of an adjacent following sheet to the deceleration apparatus comprised of the first decelerator 26 and nip or second decelerator 28 as described above. The deceleration apparatus may reduce the speed of the sheets and deliver the sheets to the hopper 11. Instead of, or in addition to, sensing means 60, in one embodiment, the servo motor 42 that drives the rotational movement of the nip or second decelerator 28 may be synchronized with the conveyor 10 and the press 56 via an encoder associated with the drum 56 and the control 58. Because three, or six, or any other fixed number of sheets may be cut out and transferred to the conveyor 10 during each rotation of the drum 56, the rotation of the servo motor 42 can be timed via an encoder associated with the drum 56 so that the motor 42 will correspondingly rotate three, six, or any such other fixed number of times during each rotation of the drum 56. To control the specific time at which rotation of the servo motor 42 is actuated, a phase shift may be utilized. Through this phase shift, the specific time at which the output shaft of the servo motor 42 is rotated, and thus the time at which the lobe ends 38 or 68 move toward the rollers 29 to engage the projected sheet 14, may be controlled. Because the finishing machine or the drum 56 registers the leading edge of each sheet, and because movement of the cam nips 35 or 65 and thus actuation of the servo motor 42 may be registered with respect to the trailing edge of each sheet, the primary input to the controller 58 may be the length of the sheet. From this input, the phase shift can be calculated so that the nip rollers 35 or 65 will move toward the rollers 29 and engage the projected sheet 14 shortly before its trailing edge 54. This engagement of the projected sheet by the rollers 35 or 65 and 29 may occur as close to the trailing edge of the projected sheet as possible, including within one or two inches, or greater or less.

Figure 10:
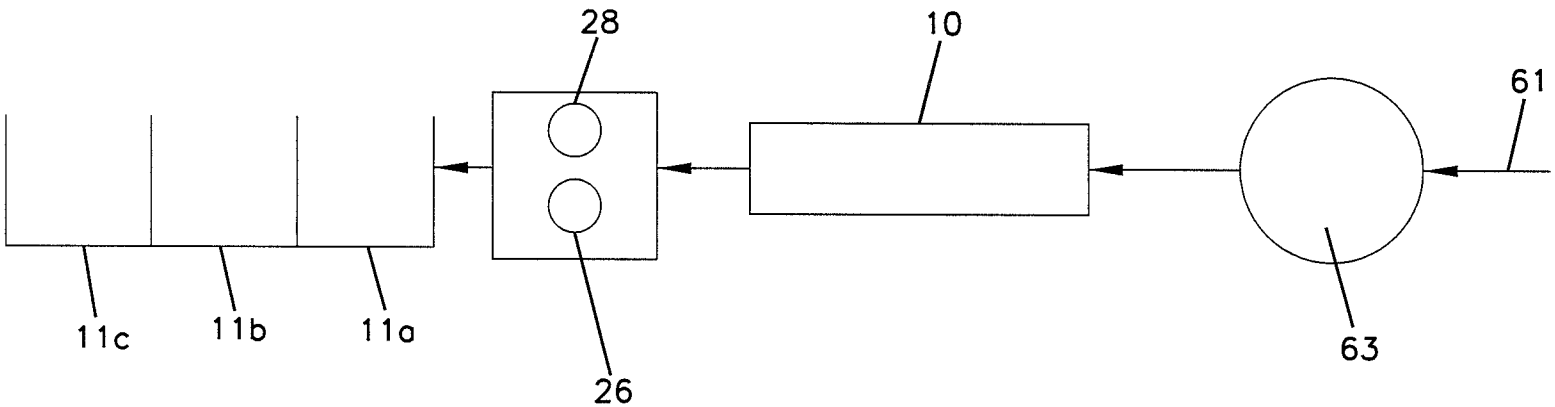
FIG. 10 is a schematic flow diagram showing a sheet formation, delivery, deceleration, and stacking system utilizing a deceleration apparatus in accordance with the present disclosure.

While the foregoing has been described with respect to embodiments in which adjacent sheets along a conveying path are stacked into a single hopper, it is to be appreciated that the apparatuses and methods of the present disclosure may be utilized to stack sheets in a plurality of hoppers. Such an embodiment may be advantageous in situations where sheets of varying size are being conveyed (e.g., a rotary die press forms sheets having varying dimensions). FIG. 10 illustrates a schematic diagram of a system for depositing sheets into a plurality of laterally-spaced hoppers (in the conveying direction) utilizing selective deceleration. In such system, corrugated or other sheets of material may be cut from a web 61 of material by a rotary press or drum 63. The rotary drum 63 may be configured such that one revolution of the drum 56 cuts out sheets of two or more configurations (e.g., variable size, shape, score line placement, etc.). These sheets may be delivered to the entry conveyor 10 described above. The entry conveyor 10 may then deliver the sheets, with gaps between the trailing edge of one sheet and the leading edge of an adjacent following sheet to the deceleration apparatus comprised of the first decelerator 26 and nip or second decelerator 28 as described above. The deceleration apparatus may selectively reduce the speed of the sheets and, depending on the magnitude of the deceleration, deliver the sheets to the one of the hoppers 11*a*, 11*b*, 11*c*. In one embodiment, the magnitude of the deceleration may be based on the size of each sheet entering the deceleration apparatus, which may determined by a sensor device or by the synchronization and encoder system discussed above. For example, the deceleration apparatus may be configured to selectively decelerate the sheets such that sheets of a first configuration are deposited into hopper 11*a*, sheets of a second configuration are deposited into hopper 11*b*, sheets of a third configuration are deposited into hopper 11*c*, and so on. In this manner, sheets produced and conveyed in the system of FIG. 10 may be deposited into a plurality of hoppers based on the configuration of the sheets. It is to be appreciated that in accordance with the embodiment of FIG. 10, the first decelerator 26 may be configured as a decelerator and an accelerator (e.g., the rollers 29 may be driven at a rotational speed such that the circumferential surface speed of the outer surface of the rollers 29 is greater than or less than the speed of the conveyor 10) to accommodate depositing of the sheets in the various hoppers.

In addition to, or as an alternative to a deceleration apparatus positioned proximate a hopper, in some embodiments, deceleration apparatuses may be positioned at other locations along a sheet conveyor and utilized to adjust, such as for purposes of calibration or synchronization, the speed of individual sheets.

Figure 11:
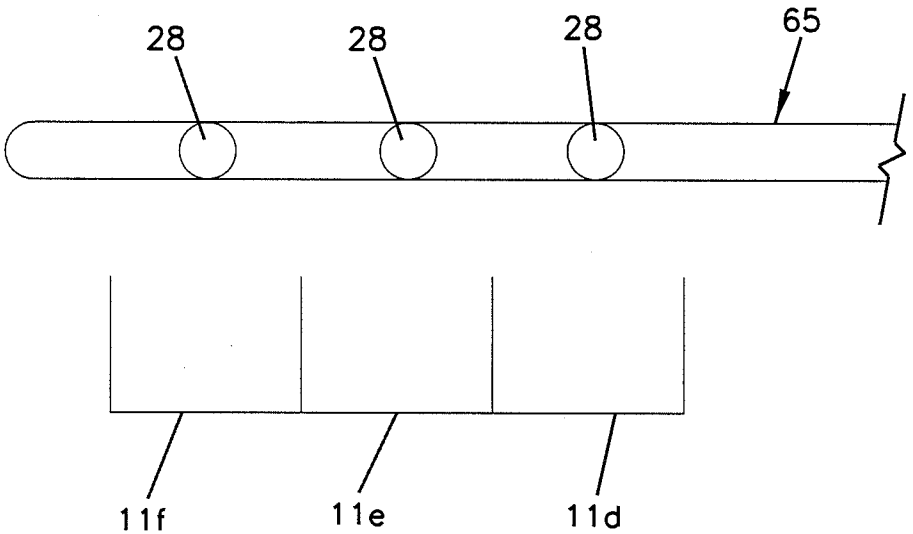
FIG. 11 is a schematic flow diagram showing delivery, and stacking system utilizing a overhead vacuum conveyor and a deceleration apparatus in accordance with the present disclosure.

In an alternative embodiment, the nip decelerators 28 of the present disclosure may be utilized in connection with the conveyance of sheets over one or more stacking hoppers 11 using an overhead vacuum conveyor. Overhead vacuum conveyors are described in U.S. Pat. No. 7,887,040, which is hereby incorporated by reference in its entirety. For example, FIG. 11 illustrates a schematic diagram of a system for depositing sheets into a plurality of laterally-spaced hoppers 11*d*, 11*e*, 11*f* utilizing an overhead vacuum conveyor 65 and a plurality of nip decelerators 28 positioned along the conveying path of the overhead vacuum conveyor 65. The overhead vacuum conveyor 65 may comprise one or more vacuums, which may operate to retain the sheets against the overhead vacuum conveyor 65. The overhead vacuum conveyor 65 may be a belt conveyor. Similar to conveyor 10, the overhead vacuum conveyor 65 could comprise a single belt extending across the width of the apparatus. However, the overhead vacuum conveyor 65 may be comprised of a plurality of laterally spaced individual belt conveyors or belt conveyor sections. These conveyor sections may be laterally spaced from one another and include an endless belt. Each of the belts may be supported by a plurality of belt support rollers. At least one of the rollers may be driven to provide the roller with its belt or line speed. The belts may move in unison to convey the sheets along the overhead vacuum conveyor 65 and toward the stacking hoppers 11*d*, 11*e*, 11*f*. Each of the nip decelerators 28 may be positioned above a corresponding hopper 11*d*, 11*e*, 11*f*. The system may track the sheets, e.g., using sensing means 60, as they convey along the overhead vacuum conveyor 65 to a position above one of the hoppers 11*d*, 11*e*, 11*f*. At some point before the leading edge of a sheet passes a hopper, the corresponding nip decelerator 28 may be rotated such that it contacts a top surface of the sheet with a force sufficient to break the vacuum seal between the sheet and the vacuum conveyor 65. Upon breaking of the seal, the sheet may be deposited into one of the hoppers 11*d*, 11*e*, 11*f*. In addition to breaking a seal between a vacuum conveyor 65 and sheet for purposes of depositing sheets into a hopper, the nip decelerators 28 may be utilized to break vacuum seals in the event of a detected sheet jam, sheet defect, etc.

In addition to use for deceleration of sheets entering a stacker hopper, the deceleration apparatuses and methods of the present disclosure may be employed in conjunction with any unit operation that requires deceleration of conveyed sheets in a controlled manner. For example, the apparatuses and methods may be employed for deceleration of sheets entering and/or exiting a folder/gluer unit operation. As an additional example, the apparatuses and methods may be used in conjunction with a sheet distribution process to more accurately set the degree of separation between adjacent sheets, the overlap/shingling of adjacent sheets, etc. For example, the deceleration apparatus may be positioned immediately upstream of a takeaway conveyor and employed to set the gap distance between adjacent sheets being passed from the apparatus to the takeaway conveyor and/or set the overlap of adjacent sheets being passed from the apparatus to the takeaway conveyor.

Although the various embodiments of the present disclosure have been described with reference to preferred embodiments, persons skilled in the art will recognize that changes may be made in form and detail without departing from the spirit and scope of the present disclosure. Accordingly, it is intended that the scope of the present disclosure be dictated by the appended claims rather than by the description of the preferred embodiment. For example, in some embodiments, the sheet stacking machine in accordance with the various embodiments of the present disclosure may be combined with an overhead vacuum means, such as but not limited to the various embodiments of overhead vacuum means described in U.S. patent application Ser. No. 12/351,496, titled "Sheet Deceleration Apparatus and Method," filed Jan. 9, 2009, previously incorporated by reference. Such an overhead vacuum means may be used to convey the sheets over the stacking hopper.

We claim:

1. A method for decelerating a sheet of material traveling along a travel path at a first speed, the method comprising:

delivering the sheet of material past a cam nip comprising at least one lobe end, the cam nip being rotatable on a first axis substantially perpendicular to the travel path; and driving rotation of the cam nip, such when the at least one lobe end of the cam nip is away from the travel path, the sheet of material can pass substantially unimpeded past the cam nip, and when the at least one lobe end is near the travel path, the sheet of material is nipped by the cam nip decelerating the sheet of material from the first speed to a second speed;

wherein the at least one lobe end comprises a rotatable wheel;

wherein said cam nip comprises at least two lobe ends and each lobe end comprises a rotatable wheel.

2. The method of claim 1, wherein delivering the sheet of material past a cam nip comprises delivering the sheet of material between a roller and the cam nip, the cam nip and roller being rotatable on first and second axes, respectively, the first and second axes being substantially perpendicular to the travel path.

3. The method of claim 2, wherein when the at least one lobe end of the cam nip is away from the roller, the sheet of material can pass substantially unimpeded between the cam nip and roller, and when the at least one lobe end is near the roller, the sheet of material is nipped between the cam nip and the roller decelerating the sheet of material from the first speed to a second speed.

4. A sheet stacking apparatus comprising:

an entry conveyor for delivering sheets of material along a travel path toward a discharge end of the entry conveyor;

a stacking hopper positioned downstream from the discharge end of the entry conveyor;

a sheet deceleration apparatus positioned between the discharge end of the entry convey- or and the stacking hopper for reducing the travel speed of the sheets of material prior to delivery to the stacking hopper, the sheet deceleration apparatus comprising:

a rotatable cam nip being rotatable about a first axis, the first axis being substantially perpendicular to the travel path and the cam nip being positioned on one side of the travel path;

wherein the cam nip comprises at least two lobe ends, such that when the lobe ends are generally away from the travel path, the sheet of material can pass substantially unimpeded past the cam nip, and when a lobe end is near the travel path, the sheet of material is nipped by the cam nip decelerating the sheet of material from the first speed to a second speed;

wherein the lobe ends each comprise a rotatable wheel.

5. The sheet stacking apparatus of claim 4, wherein at least one of the lobe ends comprises a generally roundish tip.

6. The sheet stacking apparatus of claim 4, wherein at least one of the lobe ends comprises a rotatable wheel.

7. The sheet stacking apparatus of claim 4, wherein each rotation of the cam nip is configured to decelerate two adjacent sheets of material.

* * * * *